US007013977B2

(12) United States Patent
Nordaas

(10) Patent No.: US 7,013,977 B2
(45) Date of Patent: Mar. 21, 2006

(54) SEALED CONNECTORS FOR AUTOMATIC GUN HANDLING

(75) Inventor: Lars B. Nordaas, Fyllingsdalen (NO)

(73) Assignee: Halliburton Energy Services, Inc., Houston, TX (US)

( * ) Notice: Subject to any disclaimer, the term of this patent is extended or adjusted under 35 U.S.C. 154(b) by 53 days.

(21) Appl. No.: 10/460,018

(22) Filed: Jun. 11, 2003

(65) Prior Publication Data

US 2004/0251028 A1 Dec. 16, 2004

(51) Int. Cl.
*E21B 43/116* (2006.01)

(52) U.S. Cl. ..... 166/297; 166/55.1

(58) Field of Classification Search ..... 166/298, 166/297, 55, 55.1, 63, 77.51
See application file for complete search history.

(56) References Cited

U.S. PATENT DOCUMENTS

| | | | | |
|---|---|---|---|---|
| 4,526,233 A | | 7/1985 | Stout | 166/377 |
| 4,544,034 A | * | 10/1985 | George | 166/297 |
| 4,650,009 A | | 3/1987 | McClure et al. | 175/4.6 |
| 4,776,393 A | | 10/1988 | Forehand et al. | 166/55.1 |
| 4,804,044 A | * | 2/1989 | Wesson et al. | 166/297 |
| 4,815,540 A | | 3/1989 | Wallbillich, III | 166/377 |
| 4,822,230 A | | 4/1989 | Slettedal | 414/22.54 |
| 4,850,438 A | | 7/1989 | Regalbuto | 175/4.56 |
| 4,901,802 A | * | 2/1990 | George et al. | 175/4.52 |
| 4,917,187 A | * | 4/1990 | Burns et al. | 166/297 |
| 5,603,379 A | | 2/1997 | Henke et al. | 166/297 |

FOREIGN PATENT DOCUMENTS

| | | |
|---|---|---|
| EP | 0728913 A2 | 8/1996 |
| GB | 2250043 A | 5/1992 |

OTHER PUBLICATIONS

United Kingdom Search Report (GB0412767.6), Aug. 25, 2004, 4 pages.

* cited by examiner

*Primary Examiner*—Frank S. Tsay
(74) *Attorney, Agent, or Firm*—Michael W. Piper

(57) ABSTRACT

A sealed perforating gun assembly for use with automatic pipe handling equipment on oil and gas drill rigs. An upper sealed connector and a lower sealed connector have sealed threaded connections for mating with ends of a perforating gun. The connectors have external dimensions equivalent to the external dimensions of standard drill pipe and have standard tapered thread couplings. Ignition transfer explosives are carried within cavities in the connectors. The cavities are sealed on their drill pipe coupling ends. The ignition transfer explosives are adapted to penetrate the seals so that ignition can be transferred between the gun assembly and adjacent sections of the gun string. Since the external dimensions of the sealed connectors correspond to the external dimensions of drill pipe, automatic drill pipe handling equipment can handle the gun assemblies.

21 Claims, 3 Drawing Sheets

SEALED CONNECTORS FOR AUTOMATIC GUN HANDLING

CROSS-REFERENCE TO RELATED APPLICATIONS

None.

STATEMENT REGARDING FEDERALLY SPONSORED RESEARCH OR DEVELOPMENT

Not applicable.

REFERENCE TO A MICROFICHE APPENDIX

Not applicable.

FIELD OF THE INVENTION

This invention relates to perforating guns for use in hydrocarbon wells and more particularly to an assembly of sealed connectors and perforating guns which allow perforating guns to be handled by automatic pipe handling apparatus.

BACKGROUND OF THE INVENTION

The completion of oil and gas wells by gun perforating is well known in the art. A work string including one or more perforating guns is lowered into a well casing cemented into the wellbore. The perforating guns are positioned adjacent to the formation to be perforated. The perforating guns are fired to penetrate the casing and cement and form perforations into the producing formation for recovery of the desired fluids. These perforating guns typically utilize shaped charges to form the perforations.

Typically, a firing head is positioned at the top of the string of guns and is connected to the uppermost gun of a string of guns. A time domain firer (TDF) is positioned between adjacent pairs of guns. When the firing head is triggered, the uppermost gun is then fired, and the time domain firers then cause the string of guns to be fired sequentially from top to bottom. On occasion, the firing sequence is from bottom to top.

There is inherent risk in handling the explosive components which must be assembled to make a perforating gun. Even after the guns are assembled, there is risk in handling the completed guns. The assembled guns are typically connected to a drill string for placement in the borehole. Safety regulations increasingly discourage or prohibit the manual handling of perforating guns on drill rigs due the risks involved. As a result, there is a need for apparatus and methods which allow perforating guns to be handled automatically on drill rigs.

SUMMARY OF THE INVENTION

One embodiment of the present disclosure provides a perforating gun assembly having external dimensions corresponding to the dimensions of standard drill pipe joint couplings, and adapted for handling by automatic drill pipe handling systems. One or more conventional perforating guns is assembled with two sealed subs having pipe joint threaded couplings.

In one embodiment, the interior of each sealed sub carries a bi-directional explosive for transferring a detonation to or from the perforating gun.

The perforating gun assembly of the present disclosure is assembled into a drill string with conventional drill pipe handling equipment. Multiple assemblies may be connected together like standard drill pipe joints. When the guns are fired, the explosive transfer path couples the detonation to successive guns to fire the entire string.

DETAILED DESCRIPTION OF THE PREFERRED EMBODIMENTS

In the following description, the terms "upper", "upward", "uphole", "lower", "above", "below", "downhole", and the like, as used herein shall mean in relation to the bottom, or furthest extent as measured from the surface location, of the wellbore even though portions of it may be deviated from vertical or may be horizontal. These terms are intended to describe the relative position of a perforating gun in the vertical position normally used for assembling the gun into or as part of a drill string or work string for lowering into a borehole. Boreholes are normally essentially vertical at their surface location. Work strings and drill strings are normally connected together joint by joint or section by section at the borehole surface location as they are lowered into the borehole. While perforating guns may be lowered into a borehole on a string of drill pipe, it is understood that perforating gun assemblies are not designed to withstand the torque normally encountered during drilling operations and would not be present during drilling operations. These terms are used for convenience in describing the invention and are not intended to be limiting.

Figure 1:
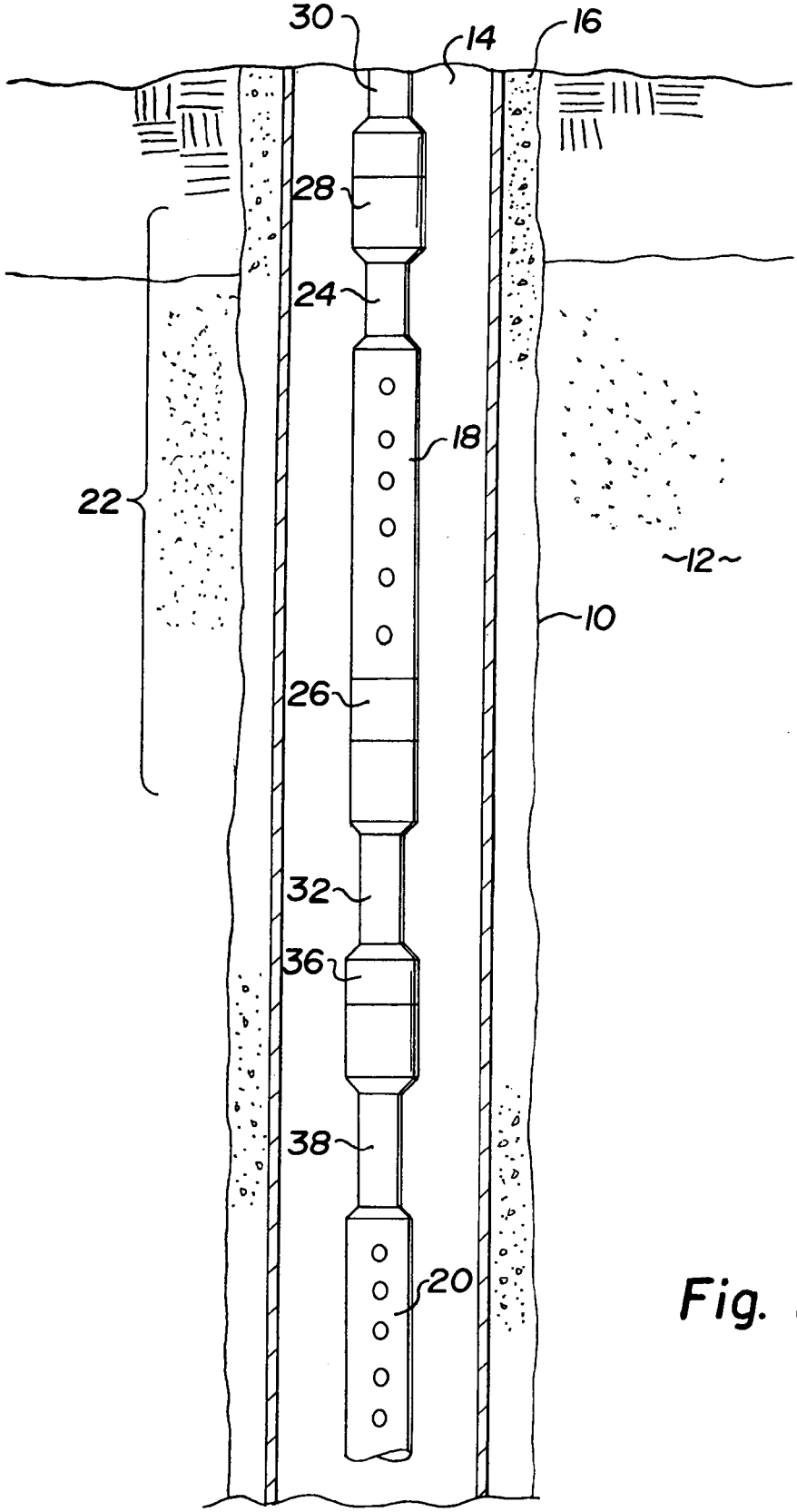
FIG. 1 is generalized illustration of a borehole in the earth with a pipe string carrying a perforating gun assembly according to the present invention.

FIG. 1 illustrates a borehole 10 passing through an earth formation 12, from which it may be desired to produce fluids. The borehole 10 is lined with a casing 14 which is set in the borehole 10 with cement 16. Two perforating guns 18 and 20 are shown positioned in the borehole 10 within the zone 12 in preparation for forming perforations through the casing 14 and cement 16 to allow fluids to flow from formation 12 into the casing 14.

A perforating gun assembly 22 according to the present invention includes the perforating gun 18. It also includes an upper sealed connector 24 and a lower sealed connector 26. The upper connector 24 includes a drill pipe box coupling 28 having an internal tapered thread. The external dimensions of coupling 28 are within the tolerances for a standard box coupling of standard drill pipe. As a result, tools designed for handling of standard drill pipe are capable of handling the gun assembly 22 as if it were a drill pipe joint.

The lower sealed connector 26 includes a drill pipe pin coupling having an external tapered thread, not shown in this figure. The external dimensions of this coupling, in particular the external upset, are within the tolerances for a standard pin coupling of standard drill pipe. As a result, standard drilling equipment, e.g. an iron roughneck, can grip the coupling 26 for making or breaking a threaded joint.

The assembly 22 is suspended in the borehole 10 by a drill string including a pipe joint 30 which may include a firing assembly and detonator for the gun modules 18 and 20. The lower end of joint 30 includes a standard pin coupling connected to the upper sealed connector 24. Another section of drill pipe 32 may have an upper box coupling connected to lower sealed connector 26. A lower pin coupling 36 of joint 32 may be connected to an upper sealed connector 38 forming part of a second perforating gun assembly according to the present disclosure including the perforating gun 20. The section 32 may include detonating cord running from end to end to transfer ignition between gun modules 18 and 20.

Figure 2:
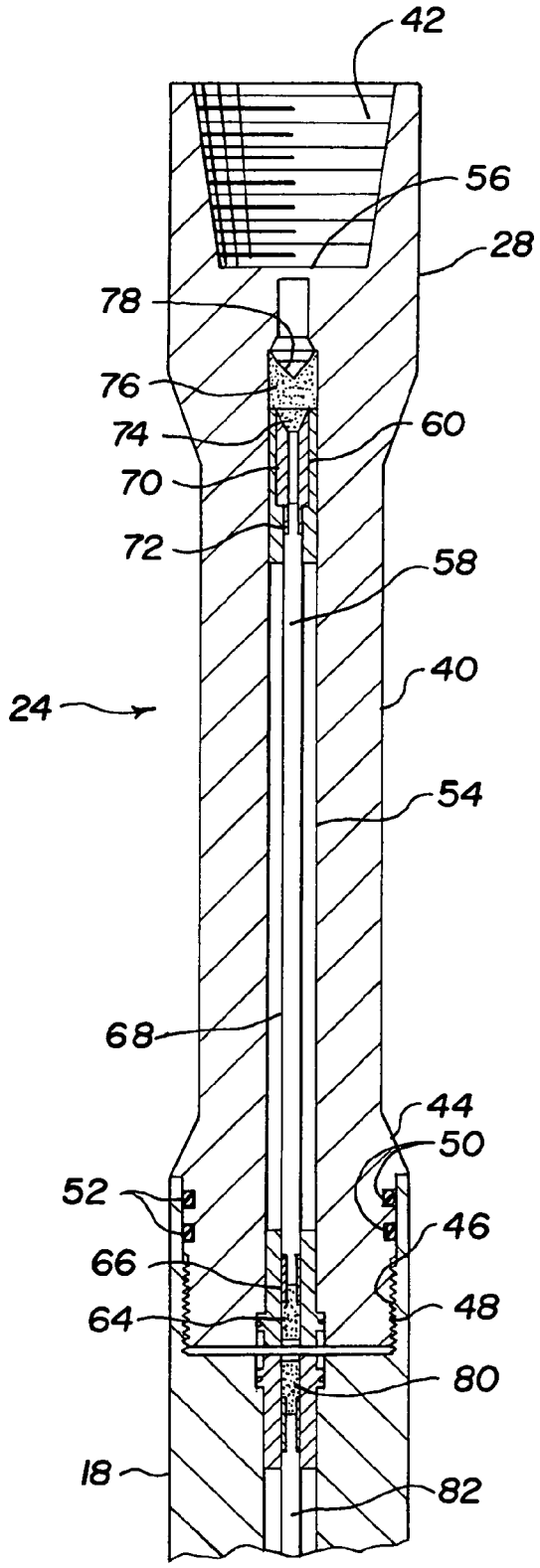
FIG. 2 is a cross sectional illustration of an upper sealed connector and a portion of a perforating gun according to the present invention.

FIG. 2 provides a cross sectional illustration of the upper sealed connector 24 and a portion of the perforating gun 18 according to the present invention. As discussed above, most of the external dimensions and shape of the upper connector 24 are equivalent to standard drill pipe, or tool, joints. For example, the main body 40 of connector 24 may be a cylinder having a nominal outer diameter of 3.5 inch, as used in standard 3.5 inch drill pipe. In this embodiment, this main body 40 has a length of about thirteen inches. At the upper end of body 40 is a external upset 28 having an external nominal diameter of about 4.75 inch. As illustrated, the upset portion 28 has a standard tapered internal thread 42 complementary to standard drill pipe pin couplings. On the lower end of body 40 is another upset 44 adapted for coupling to a standard perforating gun module 18 female threaded end. The upset 44 includes a straight section 46 having external acme threads complementary to internal acme threads 48 on the upper end of gun module 18. The upset 44 has two grooves 50 in which are carried O-rings 52 to form a fluid tight seal with the gun 18.

The upper connector 24 has a central cavity 54 extending from its lower end in upset 44 almost to the bottom of the box thread 42 in the upper end of the connector 24. The cavity 54 is closed at its upper end by a thin wall 56 forming part of the bottom of the box coupling 42.

An explosive device 58 is disposed in housing cavity 54 and is adapted to provide an explosive transfer in either direction between the upper end of connector 24 and the perforating gun 18. Device 58 may comprise an insert 60 which is held in the upper end of cavity 54 by a retaining means, such as the frictional engagement of an O-ring. A booster charge 64 is disposed in the lower end of insert 58. Booster 64 has a metallic portion 66 which is crimped around the lower end of a length of detonating cord 68. A detonating cord initiator 70 has a metallic portion 72 which is crimped around the upper end of detonating cord 68. The detonating cord 68 is carried loosely within the cavity 54 and is held in place by connection to the booster charges at its ends. Detonating cord initiator 70 also includes a powder charge 74. A shaped charge 76 having a conical cavity 78 is positioned adjacent to the charge 74. The shaped charge 76 cavity 78 is directed toward the wall 56 closing the upper end of cavity 54. The charge 76, upon detonation, will perforate the wall 56 in order to transfer ignition to devices connected above the connector 24. Alternatively, a detonator or other ignition transfer device above connector 24 may have a similar shaped charge which can perforate wall 56 to ignite the shaped charge 76 and the rest of device 58 to transfer ignition to the perforating gun 18.

The perforating gun 18 is connected to the lower end of upper connector 24 by the threaded joint 46, 48. A fluid tight seal for the joint is provided by the O-rings 52. A booster 80 is positioned in gun 18 adjacent the booster 64 in the lower end of upper connector 24. The booster 80 is connected to a detonating cord 82, which is coupled to perforating charges, preferably shaped charges, in the gun 18. There are no seals or metal walls separating the booster charges 64 and 80. Upon ignition of either charge, the ignition will be transferred to the other charge.

Figure 3:
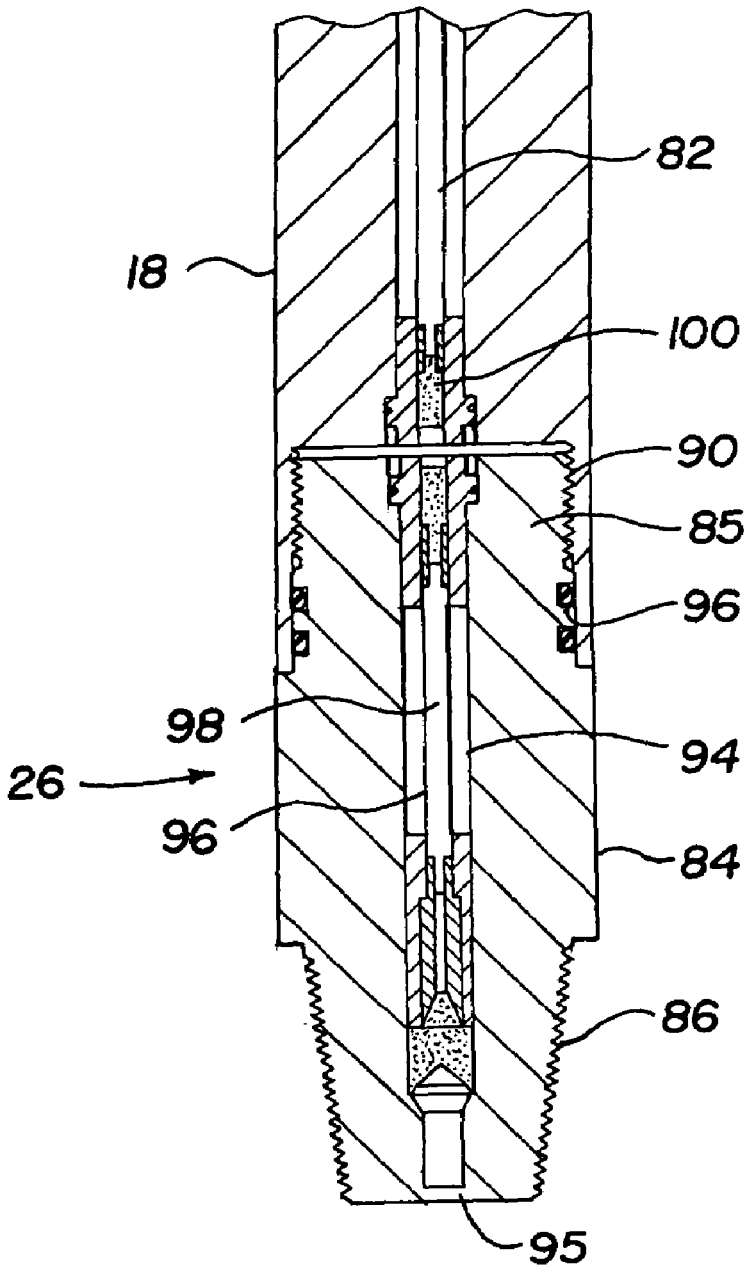
FIG. 3 is a cross sectional illustration of a lower sealed connector and a portion of a perforating gun according to the present invention.

FIG. 3 provides a cross sectional illustration of the lower sealed connector 26 and a lower portion of the perforating gun 18 according to the present invention. The lower connector 26 has external dimensions equivalent to standard drill pipe, or tool, couplings. For reasons which will become apparent, in this embodiment, the lower connector 26 does not have a body portion having the nominal drill pipe diameter. Instead, it has an upset portion 84 having a nominal diameter of 4.75 inch corresponding to standard drill pipe pin coupling upsets. Below the upset 84 is a tapered thread pin coupling 86. The upset 84 and coupling 86 have dimensions corresponding to standard drill pipe, or tool joint, pin couplings. Above the upset 84 is a straight threaded section 85 adapted for forming a sealed connection with a female end of perforating gun 18. The section 85 has an acme threaded section 90 and O-ring section 92 for making a sealed threaded connection to the lower end of gun 18.

The lower connector 26 has an internal cavity 94 extending from the upper end of the threaded section 85 to a thin wall 96 at the lower edge of pin coupling 86. Carried within cavity 94 is an explosive device 96 which may be essentially identical to the explosive device 58 carried within the upper connector 24. The detonating cord 98 in lower connector 26 is somewhat shorter than the cord 68, since the lower connector 26 can be shorter than the upper connector 24.

The lower end of gun 18 carries a booster charge 100 positioned opposite the explosive device 96 in the lower connector 26. It also includes the other end of detonating cord 82. The charge 100 is adjacent the device 96 in the lower connector. There are no seals or metal walls separating the charges 96 and 100. Upon ignition of either charge, the ignition will be transferred to the other charge.

In this embodiment, the connectors 24, 26 each have a male threaded section 46, 85 adapted for threaded coupling to a female threaded end of a perforating gun unit. This arrangement is preferred because the most common gun units have female threaded couplings on both ends. It is apparent that the ends of connectors 24, 26 adapted for connection to the perforating gun may be provided with a female threaded coupling if needed for perforating guns which may have a male threaded coupling, or which may be assembled with a tandem coupler.

The present disclosure allows for safe handling of perforating guns on drilling rigs. It allows the guns to be assembled into work strings and lowered into a borehole automatically so that workers are not exposed to injury from accidental ignition of the guns. The assembly of a perforating gun 18 with an upper connector 24 and a lower connector 26 can be carried out in a controlled environment in a building away from the drill rig. If desired, more than one gun 18 can be connected into a gun assembly with one upper connector 24 and one lower connector 26. In some embodiments a conventional tandem gun connector may be used for mechanically and explosively coupling successive guns. In any case, the completed assembly is completely sealed. That is, all explosive components are encased in metal housings. The upper and lower ends are sealed by the walls 56 and 96 in upper and lower connectors 24 and 26. This greatly reduces the chance of accidental ignition as a result of accidental mechanical contact, flame or electrical spark. The completed assembly can be pressure tested at the factory to check for fluid leaks. There is no need to open the completed gun assembly after testing. This helps a void damage by leakage of drilling fluids when the gun 18 is positioned in a borehole.

The completed gun assembly, with upper and lower connectors 24, 26, can be transported to the drill site like other tubular goods. It can be handled with the same pipe handling equipment used to handle drill pipe, tool joints, etc. When it is time to install the gun or guns in a borehole for firing, the gun assembly is automatically lifted into position on the drill rig without need for human contact or exposure. Automatic elevators are designed to grip the upper end of drill pipe joints with bushings shaped to fit the upper external upset of the upper coupling and a length of the joint below the upset. The upper connector 24 body section 40 preferably has a length sufficient to be gripped in this manner by conventional elevator equipment. The disclosed embodiment length of about thirteen inches was selected based on the dimensions of such elevator equipment. The outer diameters of the upsets 28 and 84 are of the standard diameters for which iron roughneck tools are designed to grip for making up threaded joints as pipe is run in the borehole or breaking those joints when pipe is being removed from the borehole.

As illustrated in FIG. 1, two gun assemblies 18 and 20 may be separated by a spacer section 32. The section 32 normally would carry an ignition coupling charge. The section 32 may be made of a conventional ignition coupling device between an upper connector 24 and lower connector 26 according to the present disclosure. This arrangement allows the ignition coupling joint 32 to also be handled and assembled into the pipe string entirely by automatic equipment on the drill rig.

While the present invention has been illustrated and described with respect to certain specific apparatus and methods of operation, it is apparent that various changes can be made within the scope of the present invention as defined by the appended claims.

What we claim as our invention is:

1. A perforating gun assembly comprising:

an upper connector having a drill pipe coupling on an under end and having a lower end threaded to mate with a perforating gun, a perforating gun module having a first end threaded to the lower end of the upper connector, and a lower connector having a drill pipe coupling on a lower end and having an upper end threaded to a second end of the perforating gun module.

2. A perforating gun assembly according to claim 1, wherein:

the threaded connections between the upper connector and the perforating gun and between the lower connector and the perforating gun each comprise a fluid tight seal.

3. A perforating gun assembly according to claim 1, wherein:

the lower connector has external dimensions adapted for handling by an iron roughneck.

4. A perforating gun assembly comprising:

an upper connector having a drill pipe coupling on an upper end and having a lower end threaded to mate with a perforating gun, a perforating gun module having a first end threaded to the lower end of the upper connector, a lower connector having a drill pipe coupling on a lower end and having an upper end threaded to a second end of the perforating gun module, a first cavity in the upper connector extending from an opening at the upper connector lower end to a lower side of a seal wall at the upper end, an explosive carried in the first cavity extending from the opening to the seal wall, a second cavity in the lower connector extending from an opening at the upper end to a upper side of a seal wall at the lower end, and an explosive carried in the second cavity extending from the opening to the seal wall.

5. A perforating gun assembly comprising:

an upper connector having a drill pipe coupling on an upper end and having a lower end threaded to mate with a perforating gun, a perforating gun module having a first end threaded to the lower end of the upper connector, and said upper connector comprises a body section having nominal drill pipe diameter between the upper end and the lower end.

6. A perforating gun assembly comprising:

an upper connector having a drill pipe coupling on an upper end and having a lower end threaded to mate with a perforating gun, and a perforating gun module having a first end threaded to the lower end of the upper connector, wherein the upper connector has external dimensions adapted for handling by automatic drill pipe handling equipment.

7. A perforating gun assembly according to claim 6, further comprising:

a first cavity in the upper connector extending from an opening at the upper connector lower end to a lower side of a seal wall at the upper end, and an explosive carried in the first cavity extending from the opening to the seal wall.

8. A perforating gun assembly according to claim 6, wherein:

the upper connector has external dimensions adapted for handling by an iron roughneck.

9. Apparatus for handling a perforating gun, comprising:

a first connector having an upper end, a lower end and a linear portion between said upper and lower ends, the upper end and linear portion having external dimensions equivalent to standard drill pipe adapted for handling by automatic drill pine handling equipment, the upper end having a threaded portion adapted for threaded connection to a drill pipe coupling, and the lower end having a threaded portion adapted for threaded connection to a perforating gun.

10. Apparatus according to claim 9, further comprising:

a cavity extending from an opening in the lower end to a lower side of a seal wall in the upper end.

11. Apparatus according to claim 10, further comprising:

an explosive device carried in said cavity and extending from said opening to said seal wall.

12. Apparatus for handling a perforating gun, comprising:

a first connector having an upper end, a lower end and a linear portion between said upper and lower ends, the upper end and linear portion having external dimensions equivalent to standard drill pipe, the upper end having a threaded portion adapted for threaded connection to a drill pipe coupling, a second connector having an upper end and a lower end, the second connector upper end having external dimensions equivalent to standard drill pipe, the second connector lower end having a threaded portion adapted for threaded connection to a drill pipe coupling, and the second connector upper end having a threaded portion adapted for threaded connection to a perforating gun.

13. Apparatus according to claim 12, further comprising:

a cavity extending from an opening in the upper end to an upper side of a seal wall in the lower end.

14. Apparatus according to claim 13, further comprising:

an explosive device carried in said cavity and extending from said opening to said seal wall.

15. A method for installing a perforating gun in a work string on a drill rig, comprising:

at a site other than the drill rig, making a first perforating gun assembly by assembling an upper connector and a lower connector to opposite ends of a perforating gun, said connectors each having a coupling adapted for connection to standard drill pipe couplings, transporting the first assembly to a drill rig, and using automatic pipe handling equipment to connect the first assembly into a work string.

16. A method according to claim 15, wherein the upper and lower connectors form fluid tight seals with the perforating gun, further comprising, at a site other than the drill rig, leak testing the assembly.

17. A method according to claim 15, further comprising:

installing explosive transfer charges in at least one of the upper and lower connectors.

18. A method according to claim 15, further comprising:

at a site other than the drill rig, making a second perforating gun assembly by assembling an upper connector and a lower connector to opposite ends of a perforating gun, said connectors each having a coupling adapted for connection to standard drill pipe couplings, transporting the second assembly to a drill rig, and using automatic pipe handling equipment to connect the first assembly to the second assembly.

19. A method for installing perforating guns in a work string on a drill rig, comprising:

at a site other than the drill rig, making a perforating gun assembly by;

connecting the lower end of a first perforating gun to the upper end of a second perforating gun, connecting an upper connector to the upper end of the first perforating gun, and connecting a lower connector to the lower end of the second perforating gun, said upper and lower connectors each having a coupling adapted for connection to standard drill pipe couplings, transporting the perforating gun assembly to a drill rig, and using automatic pipe handling equipment to connect the assembly into a work string.

20. A method according to claim 19, wherein the upper and lower connectors form fluid tight seals with the perforating guns, further comprising, at a site other than the drill rig, leak testing the assembly.

21. A method according to claim 19, further comprising:

installing explosive transfer charges in at least one of the upper and lower connectors.

* * * * *

UNITED STATES PATENT AND TRADEMARK OFFICE

CERTIFICATE OF CORRECTION

PATENT NO. : 7,013,977 B2
APPLICATION NO. : 10/460018
DATED : March 21, 2006
INVENTOR(S) : Lars B. Nordaas It is certified that error appears in the above-identified patent and that said Letters Patent is hereby corrected as shown below:

Claim 9, Col.6, line 44, replace “pine” with --pipe --

Signed and Sealed this

Twenty-second Day of August, 2006

JON W. DUDAS
*Director of the United States Patent and Trademark Office*